US005356479A

United States Patent [19]

Menke et al.

[11] Patent Number: 5,356,479

[45] Date of Patent: Oct. 18, 1994

[54] METHOD FOR CLEANING BATHROOM FITTINGS

[75] Inventors: Ronald Menke, Mettmann; Bernd-Dieter Holdt, Duesseldorf; Petra Plantikow, Ratingen, all of Fed. Rep. of Germany

[73] Assignee: Henkel Kommanditgesellschaft auf Aktien, Duesseldorf, Fed. Rep. of Germany

[21] Appl. No.: 934,381

[22] Filed: Aug. 24, 1992

[30] Foreign Application Priority Data

May 18, 1992 [DE] Fed. Rep. of Germany ..... 4216380

[51] Int. Cl.[5] ..... B08B 7/00

[52] U.S. Cl. ..... 134/2; 134/3; 134/40; 134/42; 134/22.14

[58] Field of Search ..... 134/2, 3, 40, 42, 22.14

[56] References Cited

U.S. PATENT DOCUMENTS 4,683,074 7/1987 Malik et al. ..... 134/3
5,076,954 12/1991 Loth et al. ..... 134/40
5,200,115 4/1993 Giesen et al. ..... 252/557

FOREIGN PATENT DOCUMENTS 0362671 4/1990 European Pat. Off. .

*Primary Examiner*—Melvyn J. Andrews
*Assistant Examiner*—Zeinab El-Arini
*Attorney, Agent, or Firm*—Wayne C. Jaeschke; John E. Drach; Henry E. Millson, Jr.

[57] ABSTRACT

Bathroom fittings and other hard surfaces are cleaned with a foam containing an alkyl polyglycoside as the principal surfactant. An effective amount of the foam is applied to a surface and removed by wiping with a cloth, sponge, or paper towel or by rinsing with water. Any residual foam remaining on the surface is not detectable by the naked eye because the residual material is transparent.

19 Claims, No Drawings

METHOD FOR CLEANING BATHROOM FITTINGS

BACKGROUND OF THE INVENTION

1. Field of the Invention

This invention relates to a method for cleaning hard surfaces, more particularly fittings in bathrooms and similar rooms.

2. Description of the Related Art

The conventional cleaning of surfaces of the type in question with water-based liquids applied with cloths or sponges is being increasingly replaced by cleaning with foam cleaners. Applying the cleaner in the form of a foam has the advantage that, by virtue of the better adhesion of foam to the surfaces, the cleaning preparation can be uniformly applied even to vertical and sloping surfaces without immediately running down those surfaces. In general, the foam is rapidly produced by means of suitable devices and the cleaning liquid is sprayed onto the surfaces. In the case of hand-operated foam spray pumps, the liquid issuing from the spray nozzle is mixed with air in such a way that it impinges on the surfaces as foam. In the case of aerosol products, the propellent gas is used to produce the foam. Although many foam preparations have already been proposed for this method of cleaning, there are still a number of problems to be solved in this method. Thus, many preparations require thorough rinsing with water and wiping dry to avoid residues of the cleaning preparation remaining visible on shiny surfaces, for example mirrors, tile surfaces or chrome surfaces. The reason for this lies in the inadequate uniformity and inadequate transparency of the cleaning preparation. Another problem in modern bathrooms lies in the cleaning of the numerous plastic articles, for example bathtubs, shower cubicles and the associated fittings. The various plastics encountered in such articles, such as polymethacrylate, polypropylene, polyacetal and high-impact polystyrene (ABS), differ greatly in the extent to which they undergo stress cracking which is intensified to a considerable extent by surfactant-cleaning preparations. Another problem arises out of the need to use flammable propellants, such as propane/butane, in aerosol preparations instead of the hitherto usual fluorocarbons. The foam produced with propellants such as these is more or less flammable under adverse conditions and thus represents a potential danger.

Accordingly, the problem addressed by the present invention was to develop a generally more suitable cleaning method which, in particular, would not be attended by any of the disadvantages mentioned above.

SUMMARY OF THE INVENTION

The present invention relates to a method for cleaning bathroom fittings and other hard surfaces with cleaning foam, in which a foam is produced from a water-based liquid containing an alkyl polyglycoside as principal surfactant. An effective amount of the foam is then applied to the surface to be cleaned and then removing the foam by some means such as by wiping with a cloth, sponge, or paper towel or by rinsing with water. Any residual foam remaining on the surface is not detectable by the naked eye because the residual material is transparent.

DESCRIPTION OF THE PREFERRED EMBODIMENTS

Other than in the operating examples, or where otherwise indicated, all numbers expressing quantities of ingredients or reaction conditions used herein are to be understood as modified in all instances by the term "about".

The cleaning method according to the invention is distinguished by a good cleaning effect, even on vertical surfaces, and—even in the absence of subsequent rinsing or polishing—leaves behind uniform and completely transparent residues which are virtually invisible even on shiny surfaces. Despite the high cleaning power of the surfactant solution used, no acceleration of stress corrosion is observed in any of the plastics typically used in bathrooms. The aqueous surfactant solution used foams easily and provides very stable foams which are substantially nonflammable, even where propane/-butane is used as propellent in aerosol preparations.

The alkyl polyglycosides used as surfactants in the water-based liquid are compounds corresponding to general formula I:

$$R—O(-G)_n \qquad \text{I}$$

in which R is a long chain alkyl radical containing 8 to 22 carbon atoms, G is a glycoside-bonded residue of a monosaccharide and n has a value of 1 to 10.

Alkyl polyglycosides have been known as surfactants for more than 50 years and can be produced by various methods. In this connection, reference is made solely to European patent application 362 671 where literature on earlier processes is also cited.

One method of importance for application on an industrial scale essentially comprises the acid-catalyzed condensation of monosaccharides of the aldose (HO-G) type with long-chain alcohols (R—OH) containing 8 to 22 and preferably 8 to 18 carbon atoms. Alkyl glycosides corresponding to formula I $$R—O(-G)_n \qquad \text{I}$$

in which the value of n can be varied within wide limits through the choice of the reaction conditions, are formed with elimination of water. Alkyl glycosides corresponding to formula I in which n=1 to 10 may be used in accordance with the invention, compounds with values for n of 1 to 6 being preferred and compounds with values for n of 1 to 2 being particularly preferred. In products where n is larger than 1, n is of course a statistical mean value.

The alkyl glycosides can also be produced from oligosaccharides or polysaccharides which, in the course of the acid-catalyzed reaction, are first depolymerized to lower fragments by hydrolysis and/or alcoholysis before the alkyl glycosides corresponding to formula I are formed. Mixtures of various reducing monosaccharides or polysaccharides containing various monosaccharide units may also be used as starting materials, in which case alkyl glycoside molecules of correspondingly mixed composition can be formed where n is greater than 1.

The following monosaccharides are preferred starting materials: glucose, mannose, galactose, arabinose, apiose, lyxose, gallose, altrose, idose, ribose, xylose and talose and also the oligosaccharides and polysaccharides composed of these monosaccharides, for example maltose, lactose, maltotriose, hemicellulose, starch, partial hydrolyzates of starch and sugar sirup. However, alkyl glycosides made up of the same monosaccharide units are preferred for the purposes of the invention. Alkyl glycosides in which the unit (-G) is derived from glucose are particularly preferred. Glucose, maltose, starch and other oligomers of glucose are correspondingly used as starting materials for these compounds which are also known as alkyl glucosides.

In the above-described synthesis, the alkyl moiety R is derived from long chain, optionally unsaturated, preferably primary alcohols which may be branched, but are preferably not branched. Examples are the synthetic alcohols containing 9 to 15 carbon atoms and the fatty alcohols containing 8 to 22 carbon atoms obtained from natural fatty acids. Fatty alcohols containing 8 to 18 carbon atoms and oxoalcohols containing 11 to 15 carbon atoms are preferred, fatty alcohols containing 8 to 10 carbon atoms or 12 to 14 carbon atoms being particularly preferred.

In addition to the actual alkyl glycosides corresponding to formula I, products produced on an industrial scale generally contain certain proportions of free alcohol R—OH and non-acetalized saccharides, optionally in oligomerized form. In most cases, these technical impurities do not interfere with the intended application. If alcohol mixtures, for example alcohols based on natural fats, are used as starting materials in the production of the alkyl glycosides, the alkyl glycosides are of course also mixtures with—accordingly—other meanings of R in formula I.

In addition to the alkyl polyglycosides, the cleaning liquids used in the method according to the invention may contain other surfactants providing they do not impair the favorable effects of the method. The other surfactants in question are, in particular, anionic surfactants, more especially long-chain alkyl sulfates. They are preferably used in the form of sodium salts. Fatty alcohol sulfates containing approximately 12 carbon atoms in the alkyl chain are particularly preferred. The total content of surfactants in the water-based liquid used in accordance with the invention is preferably between about 1% and about 6% by weight and, more preferably, between about 2% by weight and about 4% by weight.

The water-based liquids used in accordance with the invention may contain monohydric alcohols containing 2 to 3 carbon atoms, i.e. ethanol, n-propanol and isopropanol, as organic solvents. Ethanol is particularly preferred. The content of alcohols in the water-based liquid is preferably between 0.5 and 12% by weight and, more preferably between about 1 and 5% by weight. The addition of the alcohols improves the cleaning effect of the method according to the invention towards certain stains without promoting stress corrosion in plastic surfaces and without increasing the flammability of the foams. Particularly favorable results are obtained when the ratio by weight of surfactant to alcohol in the solution is between 1:1.5 and about 2:1.

In addition to the constituents mentioned, the water-based liquids used in accordance with the invention may contain other auxiliaries and additives, of the type typically used in sanitary cleaners of this type, in small quantities. Where auxiliaries and additives of the type in question are used, it is of course essential that they do not impair the positive results obtained with the method according to the invention. Examples of such auxiliaries are lime-dissolving organic acids, such as citric acid, acetic acid or lactic acid or water-soluble salts thereof which are preferably present in the water-based liquid in quantities of 2 to 6% by weight, based on the liquid as a whole. The pH value of the aqueous liquid may be mildly acidic to mildly alkaline and is preferably in the range from about pH 4 to about pH 9. Examples of other auxiliaries and additives are dyes, corrosion inhibitors, antimicrobial agents or preservatives and fragrances. The water-based liquids used in accordance with the invention preferably do not contain any polyhydric alcohols or any nonionic surfactants of the alcohol ethoxylate type.

In the method according to the invention, the foam is preferably produced immediately as the liquid leaves the spray units. In the case of hand spray pumps, this is achieved by a special design of the spray head which ensures that the water-based liquid issuing from the spray nozzle is so intensively mixed air that the liquid impinges on the surface as foam. Correspondingly designed spray pumps are commercially available. Where the cleaning liquid is applied as an aerosol, it is important to ensure, by suitably designing the spray mechanism taking the composition of the liquid into account, that sufficient quantities of propellent gas always issue together with the liquid and cause it to foam. The liquid may have to be shaken before use. The corresponding design of aerosol containers, intake nozzles and valves are routine activities to the expert and, accordingly, are not described in detail herein. An effective amount of foam is defined as the quantity of foam sprayed onto the surface necessary to remove the unwanted dirt and/or soil on the surface to be cleaned. This amount will vary and is easily determined by the user and will generally be between about 10 g and about 60 g/m$^2$ and, more particularly, between 20 g and 40 g/m$^2$. The foam is best uniformly distributed over the surface to be cleaned and is then able automatically to develop its cleaning effect. After the foam has been applied, it can be removed along with the dirt and/or soil by any convenient means normally used for cleaning a surface which has been pre-treated with cleaning material such as wiping with a cloth, sponge, or paper towel or by rinsing with clean water or a combination of water and a wiping means. The treated surfaces are preferably wiped with a damp cloth or sponge, the cloth or sponge used periodically being rinsed out with clean water in the cleaning of relatively large surfaces. Rinsing the treated surfaces with clean water to produce a completely liquid-free surface is not generally necessary because the residues of cleaning liquid left behind dry transparently and remain virtually invisible. The following examples are meant to illustrate but not limit the invention.

EXAMPLES

A number of cleaning liquids, of which the exact compositions are shown in the following Tables, were subjected to several tests to determine their suitability for use in the cleaning of bathroom fittings and similar surfaces by the foam method. The following tests were applied:

A) Residue Transparency

Small upright mirrors measuring 70×200 mm were used as the test surfaces. A quantity of 4 g of the cleaning liquid to be tested was uniformly applied in the form of foam to each mirror. After drainage of the foam and a drying time of 30 minutes, residues were visually evaluated and marked on the following scale:

1=completely transparent
2=transparent with slight streaks,
3=matt residue.

B) Damage to Plastics

These tests were carried out on various plastics in accordance with DIN 53 449, both the pin indentation method (DIN Part 1) and the bending strip method (DIN Part 3) being applied.

B1) Pin indentation method

A round steel pin was pressed into a bore in a DIN plastic test bar so that the bar was placed under stress. The test specimens were immersed in the cleaning liquid for 10 minutes, subsequently removed and left to dry. Any cracks developed were evaluated under a microscope after 24 hours and marked on the following scale:

1=unchanged
2=crack incipient, small
3=crack continuous
4=failure

B2) Bending strip method

Plastic strips corresponding in size to the DIN standard were cleaned with diisopropyl ether, secured as specified in a clamp and subjected to a load of 0.8 kg at one end to establish a stress. Strips of filter paper (15×200 mm) were then placed on the plastic and impregnated with 1 ml of the cleaning liquid without wetting the cut surfaces of the plastic strips. The contact time was 15 minutes, evaporation losses being compensated by additional liquid. After this time, the strips of filter paper were removed, but adhering product residues were not eliminated. The plastic strips were evaluated as follows after a total of 24 hours:

1=unchanged
2=silver sheen
3=cracking
4=failure.

In tests B1 and B2, five plastic strips were tested in the same way.

C) Inflammability of Aerosol Foams

The cleaning liquids to be tested were sprayed from an aerosol can under standardized conditions using a mixture of butane/propane (ratio by weight 75:25), the propellent gas being uniformly dispersed in the liquid before spraying by shaking 20 times. For the test, 20 g foam were sprayed in 4 to 5 seconds onto a 12 diameter watchglass. After waiting for 10 seconds, the inflammability of the foam surface was tested by exposure to a burning match. Evaluation was based on the length of the flame appearing which was marked on a scale of 1 (=nonflammable, no flame) to 5 (=highly flammable, active substance continues to burn).

D) Foam Stability

The aerosol product to be tested was intensively mixed by shaking 20 times. 30 g foam were then sprayed into a wide 1000 ml glass beaker. After standing for 10 minutes, the foam volume (FV) was read off from the graduation and the liquid volume (LV) formed was determined by pouring out into a measuring cylinder.

Foam stability was calculated as follows (FV, LV in ml):

$$\text{Foam stability} = \frac{FV}{\frac{LV \times 100}{30}}$$

| Marking scale: | | | |
|---|---|---|---|
| | <20 | = | mark 1: stable |
| | 10–20 | = | mark 2: moderately stable |
| | <10 | = | mark 3: unstable |
| | | | mark 4: no foam |

Tables 1 and 2 below show the composition of the cleaning liquids used which were applied as aerosol foam or as foam from hand spray pumps in the cleaning method. The filling of the aerosol cans consisted of 448 g of the cleaning liquid and 28.6 g of a mixture of butane/propane (75:25) and was mixed by shaking before each application.

TABLE 1

Composition (% by weight) of the bathroom foam cleaners (aerosols)

| Ingredient | Examples 1 | 2 | 3 | 4 | 5 | 6 | 7 | 8 | 9 | 10 |
|---|---|---|---|---|---|---|---|---|---|---|
| $C_{8/10}$ alkyl glucoside (n = 1.6) | 2.0 | 2.0 | 3.0 | 4.0 | | | | | | |
| Ethanol (96%) | 4.0 | 1.0 | | 4.0 | 2.5 | 2.5 | 2.5 | 2.0 | | 14.2 |
| Na—$C_{12}$-alkyl sulfate | | | | | 2.0 | | | | | 0.1 |
| Na-$_{c13/18}$-alkanesulfonate | | | | | | 2.0 | | | | |
| Tallow alcohol + 25 EO | | | | | | | 2.0 | | | |
| Fatty alcohol ethoxylate | | | | | | | | | | 4.3 |
| $C_{9/11}$ oxoalcohol 8 EO | | | | | | | | 2.0 | 2.0 | |
| Triethylene glycol | | | | | | | | | 5.5 | |
| Sodium citrate | 0.5 | 0.5 | 0.5 | 0.5 | 0.5 | 0.5 | 0.5 | 0.5 | 0.5 | |
| Water, fragrance, corrosion inhibitor | 93.5 | 96.5 | 93.5 | 91.5 | 95.0 | 95.0 | 95.0 | 95.5 | 92.0 | 81.5 |

Composition (% by weight) of the bathroom foam cleaners (for spray pumps)

| Ingredient | Examples 11 | 12 | 13 | 14 | 15 | 16 | 17 |
|---|---|---|---|---|---|---|---|
| $C_{8/10}$ alkyl glucoside (n = 1.6) | 3.0 | 3.0 | 1.5 | 4.0 | 4.0 | | |
| Ethanol (96%) | 2.5 | 2.5 | 2.5 | 2.0 | 2.5 | 2.5 | 2.5 |
| Na—$C_{12}$-alkyl sulfate | | | 1.5 | | | | |
| Na-$_{c13/18}$-alkanesulfonate | | | | | | 1.0 | 1.0 |
| $C_{9/11}$-oxoalcohol + 8 EO | | | | | | 3.0 | 3.0 |
| Citric acid.1$H_2O$ | 4.0 | | 4.0 | | 2.0 | 4.0 | |
| Acetic acid | | 4.0 | | | | | 4.0 |
| Lactic acid | | | | 4.0 | 2.0 | | |

TABLE 1-continued

| | | | | | | | |
|---|---|---|---|---|---|---|---|
| NaOH | 1.6 | 1.5 | 1.6 | 1.4 | 1.5 | 1.6 | 1.5 |
| Water, fragrance, dye, preservative | 88.9 | 89.0 | 88.9 | 88.6 | 88.0 | 87.9 | 88.0 |

Testing of the cleaning solutions from Tables 1 and 2 produced the following results:

| | Test method and mark | | | | |
|---|---|---|---|---|---|
| Example | A | B1 | B2 | C | D |
| 1 | 1 | 1 | 1 | 2 | 1 |
| 2 | 1 | 1 | 1 | 1 | 1 |
| 3 | 1 | 1 | 1 | 1 | 1 |
| 4 | 1 | 1 | 1 | 1 | 1 |
| 5 | 1 | 1 | 1 | 3 | 3 |
| 6 | 1 | 1 | 1 | 5 | 3 |
| 7 | 3 | 2 | 2 | 1 | 4 |
| 8 | 3 | 3 | 2 | 2 | 2 |
| 9 | 3 | 2 | 4 | 2 | 1 |
| 10 | 3 | 3 | 3 | 5 | 3 |
| 11 | 1 | 1 | 1 | — | — |
| 12 | 1 | 1 | 1 | — | — |
| 13 | 1 | 1 | 1 | — | — |
| 14 | 1 | 1 | 1 | — | — |
| 15 | 1 | 1 | 1 | — | — |
| 16 | 3 | 3 | 4 | — | — |
| 17 | 3 | 3 | 4 | — | — |

It is clear from the results that a better overall result can be obtained with the cleaning method according to the invention than with other foam cleaners (5–8) and commercially available foam cleaners (9, 10, 16, 17).

What is claimed is:

1. A method for cleaning hard surfaces in bathrooms with cleaning foam which comprises the steps of: (1) applying to a hard surface an effective amount of a foam to remove unwanted dirt and/or soil from said surface, said foam generated by a foam-generating spray unit wherein the foam is comprised of an aqueous-based liquid comprising a surfactant of the formula I $$R\text{-}O(\text{-}G)_n \qquad \text{I}$$

wherein R is an alkyl radical having from about 8 to about 22 carbon atoms, G is a glycoside-bonded residue of a monosaccharide and n has a value of 1 to 10; and (2) removing at least a portion of said foam by wiping or by rinsing with water, wherein said foam when dry is transparent and virtually invisible on the hard surface.

2. The method of claim 1 wherein said foam is further comprised of an alkyl sulfate as an additional surfactant.

3. The method of claim 1 wherein the total amount of surfactant in said foam is from about 1% to about 6% by weight.

4. The method of claim 3 wherein the total amount of surfactant in said foam is from about 2% to about 4% by weight.

5. The method of claim 1 wherein said foam is further comprised of a water-soluble organic carboxylic acid or water soluble salt thereof selected from the group consisting of citric acid, acetic acid and lactic acid and mixtures thereof.

6. The method of claim 5 wherein the concentration of said acid or water soluble salt thereof is from about 2% to about 6% by weight.

7. The method of claim 1 wherein the pH of said aqueous liquid is from about 4 to about 9.

8. A method for cleaning hard surfaces in bathrooms with cleaning foam comprising the steps of:

(1) applying to a hard surface an effective amount of a foam to remove unwanted dirt and/or soil from said surface, said foam generated by a foam-generating spray unit wherein the foam is comprised of an aqueous-based liquid comprising (a) a surfactant of the formula I $$R\text{-}O(\text{-}G)_n \qquad \text{I}$$

wherein R is an alkyl radical having from about 8 to about 22 carbon atoms, G is a glycoside-bonded residue of a monosaccharide and n has a value of 1 to 10, and (b) at least one monohydric alcohol having from 2 to 3 carbon atoms; and (2) removing at least a portion of said foam by wiping or by rinsing with water; wherein said foam when dry is transparent and virtually invisible on the hard surface.

9. The method of claim 8 wherein said alcohol is ethanol.

10. The method of claim 8 wherein the amount of said alcohol is from about 0.5% to about 12% by weight.

11. The method of claim 10 wherein the amount of said alcohol is from about 1.0% to about 5.0%.

12. The method of claim 8 wherein the weight ratio of surfactant to alcohol is from about 1:1.5 to about 2:1.

13. The method of claim 8 wherein said foam is further comprised of an alkyl sulfate as an additional surfactant.

14. The method of claim 8 wherein the total amount of surfactant in said foam is from about 1% to about 6% by weight.

15. The method of claim 14 wherein the total amount of surfactant in said foam is from about 2% to about 4% by weight.

16. The method of claim 8 wherein said foam is further comprised of a water-soluble organic carboxylic acid or water soluble salt thereof selected from the group consisting of citric acid, acetic acid and lactic acid and mixtures thereof.

17. The method of claim 16 wherein the concentration of said acid or water soluble salt thereof is from about 2% to about 6% by weight.

18. The method of claim 8 wherein the pH of said aqueous liquid is from about 4 to about 9.

19. The method of claim 8 wherein said foam is further comprised of an alkyl sulfate as an additional surfactant, and wherein the total amount of surfactant in said foam is from about 1% to about 6% by weight; and the foam also contains from about 2 to about 6% by weight of a water-soluble organic carboxylic acid or water soluble salt thereof selected from the group consisting of citric acid, acetic acid and lactic acid and mixtures thereof.

* * * * *